US008205300B2

(12) United States Patent
Lin et al.

(10) Patent No.: US 8,205,300 B2
(45) Date of Patent: Jun. 26, 2012

(54) HINGE STRUCTURE

(75) Inventors: Wan-Cheng Lin, Taipei Hsien (TW); Zhong-Qun Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng New Taipei (TW)

( * ) Notice: Subject to any disclaimer, the term of this patent is extended or adjusted under 35 U.S.C. 154(b) by 378 days.

(21) Appl. No.: 12/546,338

(22) Filed: Aug. 24, 2009

(65) Prior Publication Data

US 2010/0287734 A1 Nov. 18, 2010

(30) Foreign Application Priority Data

May 15, 2009 (CN) ..... 2009 1 0302351

(51) Int. Cl.
*E05F 1/08* (2006.01)

(52) U.S. Cl. ..... 16/308; 16/335; 16/297; 16/374

(58) Field of Classification Search ..... 16/297, 16/299, 335, 337, 339, 355, 357, 360, 374, 16/286, 308; 361/679.08, 679.11, 679.02, 361/679.15, 679.27; 455/90.3, 575.1, 575.3, 455/575.8; 379/433.12, 433.13; 348/373, 348/333.01, 333.06, 794
See application file for complete search history.

(56) References Cited

U.S. PATENT DOCUMENTS

| | | | | |
|---|---|---|---|---|
| 4,356,594 | A * | 11/1982 | Grosemans | 16/256 |
| 4,458,379 | A * | 7/1984 | Shelton | 16/297 |
| 5,894,633 | A * | 4/1999 | Kaneko | 16/306 |
| 6,018,847 | A * | 2/2000 | Lu | 16/337 |
| 6,671,928 | B2 * | 1/2004 | Huang | 16/340 |
| 2003/0046791 | A1 * | 3/2003 | Choi | 16/337 |
| 2006/0230578 | A1 * | 10/2006 | Renke et al. | 16/289 |
| 2007/0006422 | A1 * | 1/2007 | Lu et al. | 16/337 |
| 2010/0107368 | A1 * | 5/2010 | Chou et al. | 16/305 |

* cited by examiner

*Primary Examiner* — Chuck Y. Mah
(74) *Attorney, Agent, or Firm* — Altis Law Group, Inc.

(57) ABSTRACT

A hinge structure includes a first bracket, a fastener, a second bracket and a resilient member. The fastener is secured on the first bracket. The second bracket is rotatably fixed on the first bracket about the fastener. The second bracket is set in a first position near the first bracket. The resilient member is mounted around the fastener to bias the first bracket towards the second bracket.

17 Claims, 5 Drawing Sheets

HINGE STRUCTURE

BACKGROUND

1. Technical Field

The present disclosure relates to a hinge structure and, particularly, to a hinge structure opening automatically.

2. Description of Related Art

An hinge structure usually comprises a first bracket, a second bracket and a shaft. The first bracket comprises a connection portion and a socket, and the second bracket usually comprises another connection portion and a socket portion. In general, the shaft of the first bracket is rotatably assembled into the socket portion of the second bracket, the connection portion of the first bracket is connected to a first object, and the connection portion of the second bracket is connected to a second object.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
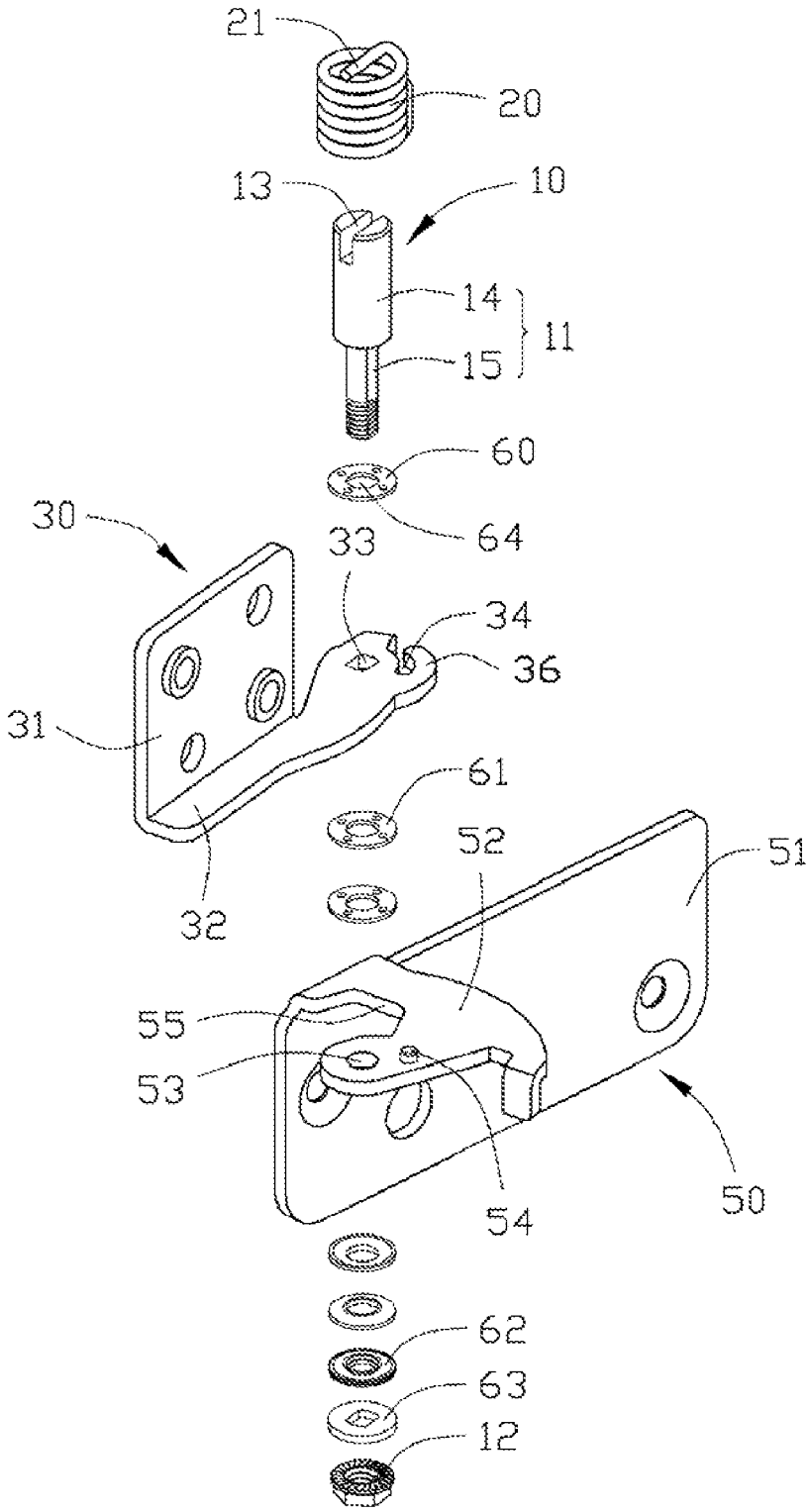
FIG. 1 is a schematic, exploded view of a hinge structure.

Referring to FIG. 1, a hinge structure includes a fastener 10, a resilient member 20, a first bracket 30 and a second bracket 50. The fastener 10 includes a screw 11 and a nut 12. A gap 13 is defined in a top portion of the fastener 10. The screw 11 includes a wide head 14 and a narrow neck 15. The neck 15 is non-circular shaped.

Figure 2:
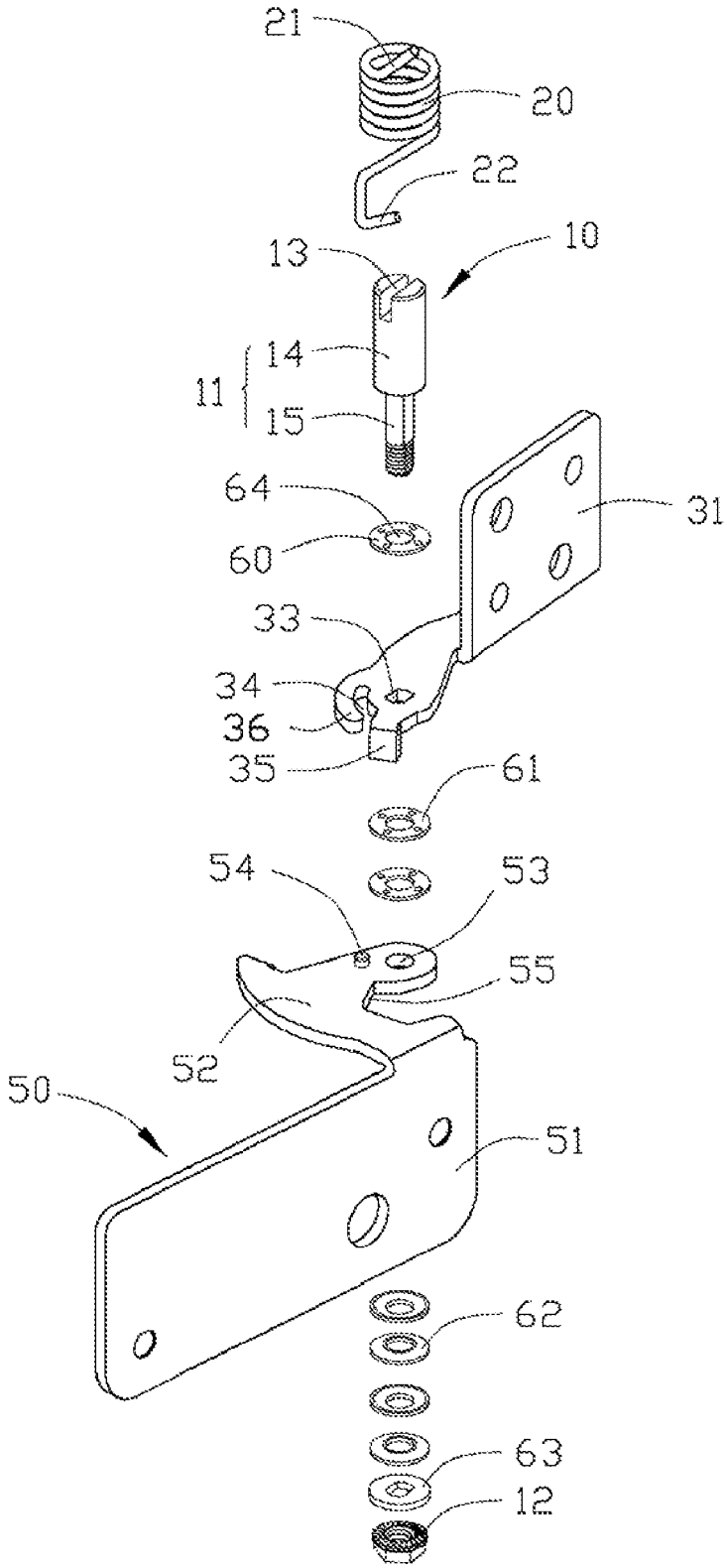
FIG. 2 is another exploded view of the hinge structure.

Referring to FIG. 2, the resilient member 20 is a torsion spring. The torsion spring is made of steel. A fixing portion 21 is formed on one end of the resilient member 20 to be insertable in the gap 13. A resisting portion 22 extends from the other end of the resilient member 20.

The first bracket 30 includes a first connecting portion 31 and a first actuating portion 32 perpendicular to the first connecting portion 31. A plurality of mounting holes is defined in the first connecting portion 31. A non-circular hole 33 is defined in the first actuating portion 32 to accommodate the neck 15 of the screw 11. An arm 36 extends from an edge of the first bracket 30, a curved guide groove 34 is defined between the arm 36 and the first actuating portion 32 adjacent to the non-circular hole 33. A block 35 extends from a free end of the first actuating portion 32. In one embodiment, the block 35 is substantially perpendicular to the first actuating portion 32.

The second bracket 50 includes a second connecting portion 51 and a second actuating portion 52 perpendicular to the second connecting portion 51. A plurality of fixing holes is defined in the second connecting portion 51. A circular hole 53 is defined in the second actuating portion 52. A protrusion 54 protrudes from the second actuating portion 52. A cutout 55 is defined in the second actuating portion 52 adjacent to the second connecting portion 51.

A plurality of washers 60, 61, 62, 63 is located among the fastener 10, the first bracket 30, and the second bracket 50. The washers 61 are set between the first bracket 30 and the second bracket 50 to decrease friction. The washers 62 are mounted between the second bracket 50 and the nut 12 to distribute axial pressure on the fastener 10. The washer 63 is installed above the nut 12 to relieve friction. A hole 64 is defined in each washer 60 to receive the fastener. 10.

Figure 3:
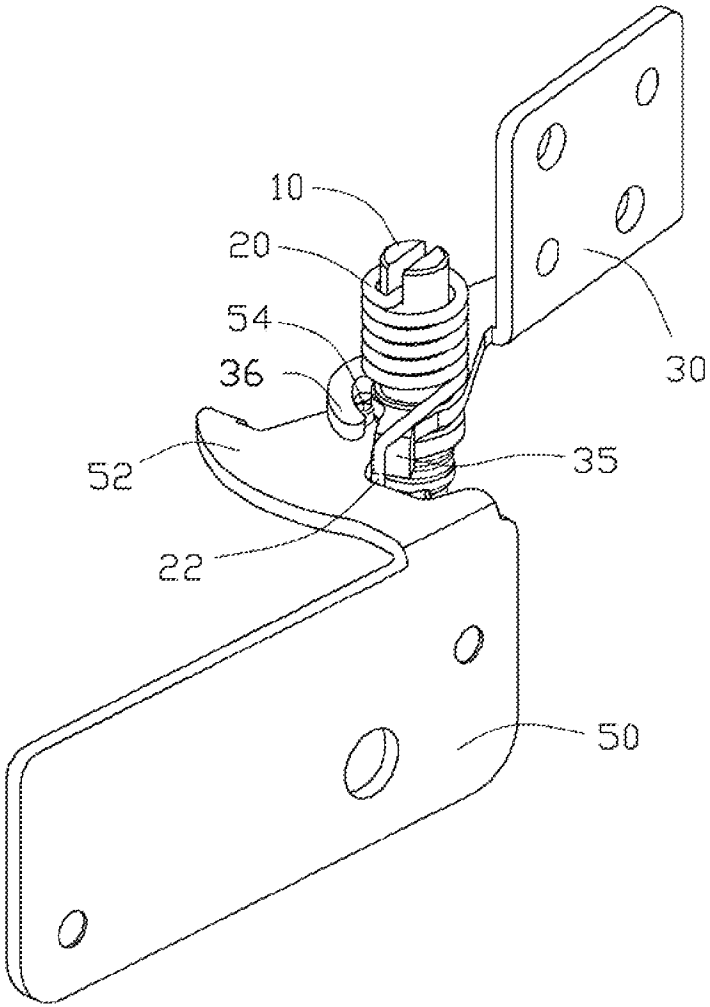
FIG. 3 is an assembled view of the hinge structure.
Figure 4:
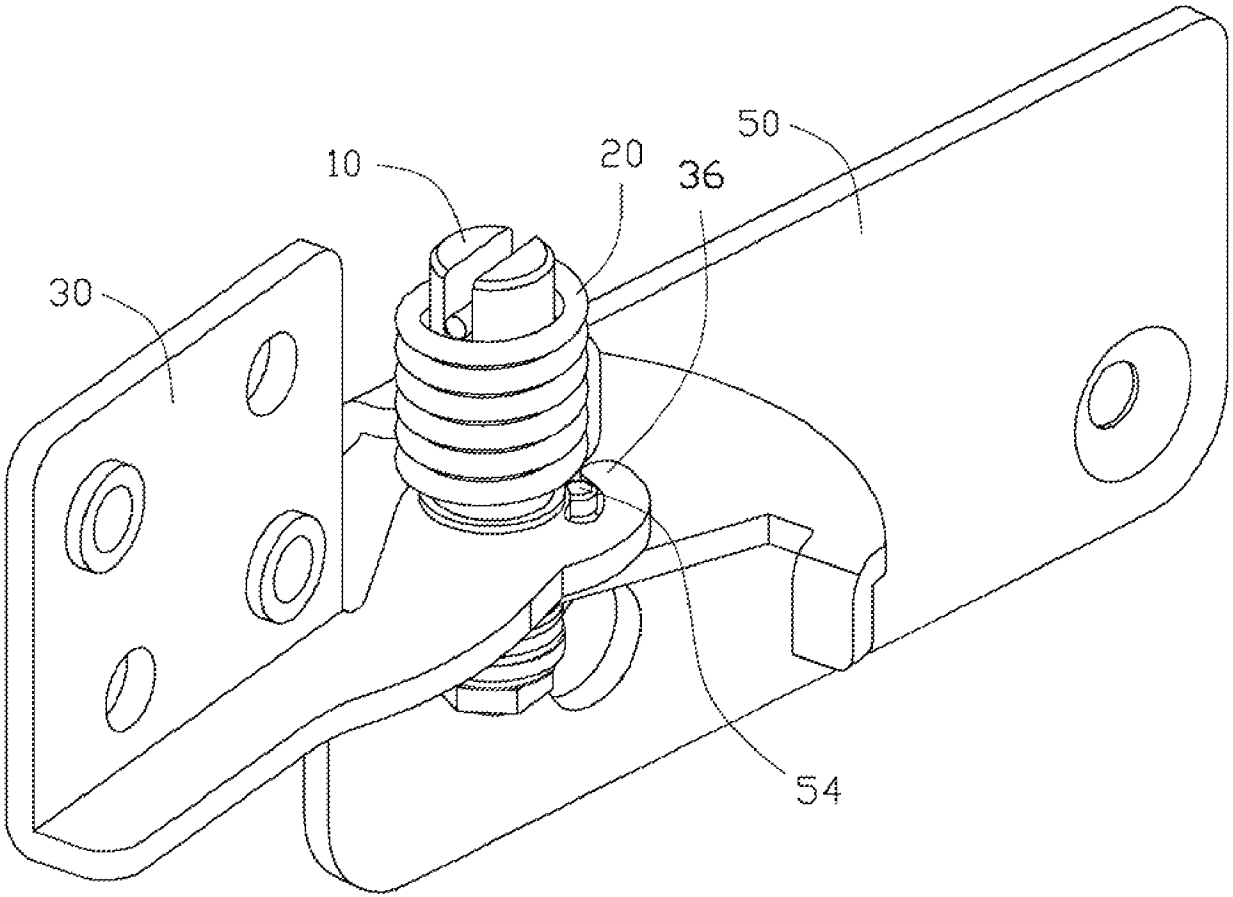
FIG. 4 is another assembled view of the hinge structure.

Referring to FIG. 3 and FIG. 4, the resilient member 20 is mounted around the head 14 of the fastener 10. The fixing portion 21 is inserted into the gap 13 of the fastener 10. The neck 15 is inserted in the non-circular hole 33, the circular hole 53 and the hole 64 of each washer 60. The first bracket 30 and the second bracket 50 are fixed by the fastener 10 and the nut 12. The head 14 is secured on the first bracket 30. The protrusion 54 cooperates with the guide groove 34 when the second bracket 50 moves toward the first bracket 30. The resisting portion 22 of the resilient member 20 resists against the cutout 55 of the second bracket 50. The resilient member 20 is set in a compressed state. The block 35 of the first bracket 30 engages with the cutout 55.

Figure 5:
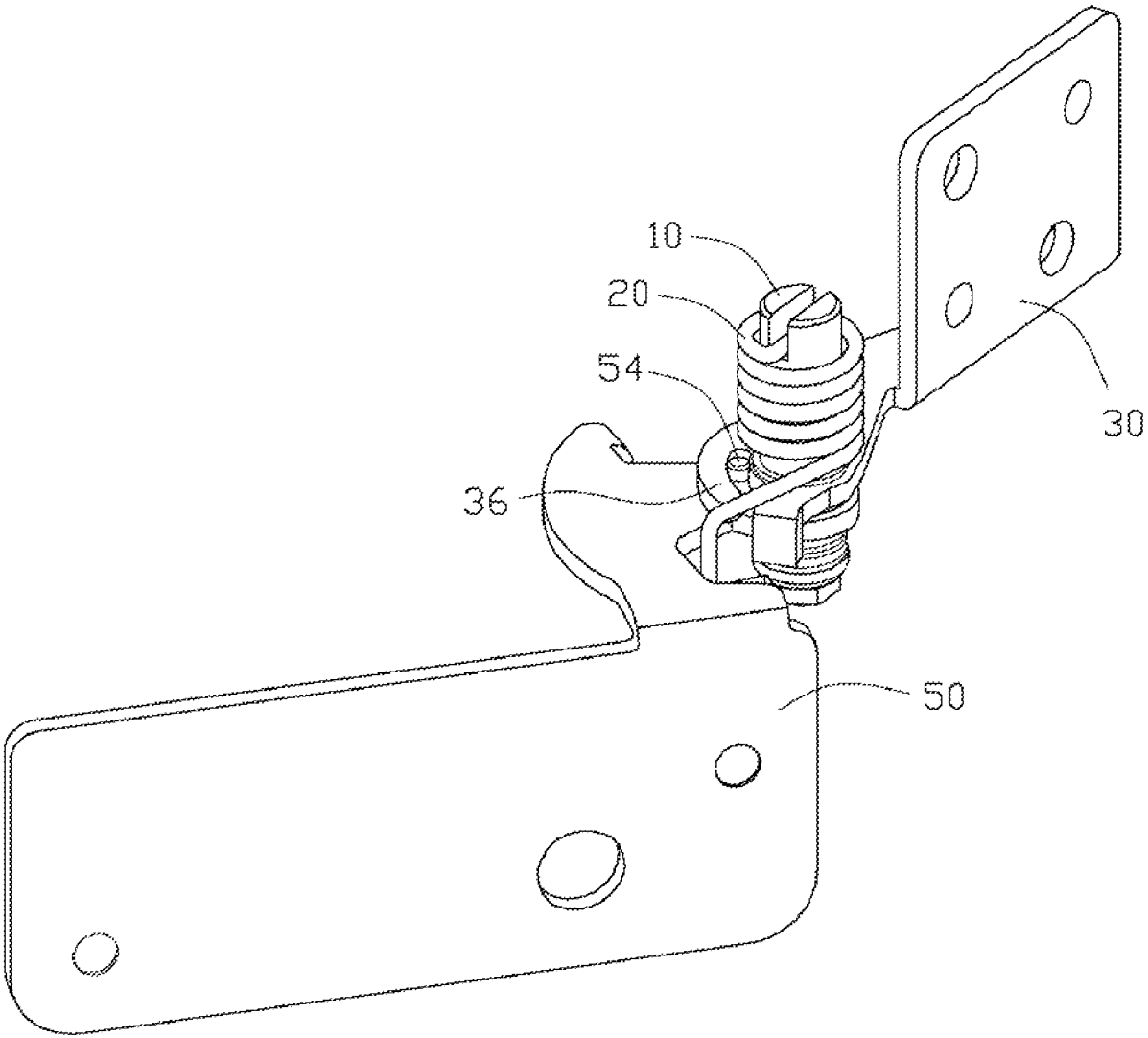
FIG. 5 is an assembled view of the hinge structure when the hinge structure is opened.

Referring to FIG. 5, when the hinge structure is opened, the resilient member 20 rebounds. The second bracket 50 slowly moves away from the first bracket 30 by resilient force of the resilient member 20. The protrusion 54 slides to a tail end of the guide groove 34. The resilient member 20 and the block 35 move away from the cutout 55.

It is to be understood, however, that even though numerous characteristics and advantages of the disclosure have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hinge structure, comprising:

a first bracket, comprising a connecting portion and an actuating portion, an arm and a block extending from said actuating portion, and a guiding groove defined between the arm and the block; the arm being elastic and comprising a free end;

a fastener secured on the first bracket;

a second bracket rotatably fixed on the first bracket about the fastener, the second bracket comprising a protrusion and a cutout;

a resilient member comprising a first end and a second end;

wherein the protrusion is slidably received in the guiding groove to deform the arm; the first end of the resilient member is fixed on the fastener, the block is received in the cutout, and the second end of the resilient member, adapted to resist against the second bracket, is sandwiched between the block and the second bracket, so that the resilient member biases the first bracket towards the second bracket.

2. The hinge structure of claim 1, wherein the resilient member is a torsion spring and is mounted around the fastener.

3. The hinge structure of claim 2, wherein a gap is defined in a top portion of the fastener to receive the first end of the torsion spring.

4. The hinge structure of claim 1, wherein the fastener has a neck with non-circular cross-section, a non-circular hole is defined in the first bracket to accommodate the neck.

5. The hinge structure of claim 4, wherein the fastener further comprises a nut, a circular pivot hole is defined in the second bracket for receiving the neck, and the neck extends through the circular pivot hole and engaged with the nut.

6. The hinge structure of claim 5, further comprising a plurality of washers attached on the fastener, at least a first one of the plurality of washers is located between the first bracket and the second bracket to decrease friction, at least a second one of the plurality of washers is located between the second bracket and the nut to distribute axial pressure on the fastener, and at least a third one of the plurality of washers is engaged with the nut to relieve friction.

7. The hinge structure of claim 1, wherein the block is substantially perpendicular to the actuating portion of the first bracket.

8. The hinge structure of claim 1 wherein the connecting portion extends from the actuating portion in a first direction, and the block extends from the actuating portion in a second direction opposite to the first direction.

9. A hinge structure, comprising:

a first bracket comprising a connecting portion and an actuating portion, a block, a guiding groove defined in the first bracket;

a fastener secured on the first bracket;

a second bracket rotatably fixed on the first bracket about the fastener, the second bracket being in a first position near the first bracket, the second bracket comprising a protrusion and a cutout;

a resilient member comprising a first end and a second end;

wherein the protrusion is slidably received in the guiding groove; the first end of the resilient member is fixed on the fastener, the block is received in the cutout, and the second end of the resilient member adapted to resist against the second bracket, is sandwiched between the block and the second bracket, so that the resilient member biases the first bracket towards the second bracket.

10. The hinge structure of claim 9, wherein the resilient member is a torsion spring and is mounted around the fastener.

11. The hinge structure of claim 10, wherein a gap is defined in a top portion of the fastener to receive the first end of the torsion spring.

12. The hinge structure of claim 9, wherein the fastener has a neck with non-circular cross-section, a non-circular hole is defined in the first bracket to accommodate the neck.

13. The hinge structure of claim 12, wherein the fastener further comprises a nut, a circular pivot hole is defined in the second bracket for receiving the neck, and the neck extends through the circular pivot hole and engaged with the nut.

14. The hinge structure of claim 9, wherein the block is substantially perpendicular to the actuating portion of the first bracket.

15. The hinge structure of claim 13, further comprising a plurality of washers attached on the fastener, at least a first one of the plurality of washers is located between the first bracket and the second bracket to decrease friction, at least a second one of the plurality of washers is located between the second bracket and the nut to distribute axial pressure on the fastener, and at least a third one of the plurality of washers is engaged with the nut to relieve friction.

16. The hinge structure of claim 9, wherein an arm extends from the actuating portion of the first bracket, the arm being elastic and comprising a free end, and when the resilient member biases the first bracket towards the second bracket, the protrusion deforms the arm.

17. The hinge structure of claim 9 wherein the connecting portion extends from the actuating portion in a first direction, and the block extends from the actuating portion in a second direction opposite to the first direction.

* * * * *